United States Patent [19]

Yuhash et al.

[11] 4,148,259

[45] Apr. 10, 1979

[54] SABOT ASSEMBLY FOR A SUBCALIBER SPIN STABILIZED PROJECTILE

[75] Inventors: Ladd Yuhash, Budd Lake, N.J.; Gary W. Fischer, Bettendorf, Iowa

[73] Assignee: The United States of America as represented by the Secretary of the Army, Washington, D.C.

[21] Appl. No.: 838,781

[22] Filed: Oct. 3, 1977

[51] Int. Cl.[2] ..... F42B 13/16
[52] U.S. Cl. ..... 102/93
[58] Field of Search ..... 102/93, DIG. 10

[56] References Cited

FOREIGN PATENT DOCUMENTS 2229443 5/1974 Fed. Rep. of Germany ..... 102/93
4937 of 1915 United Kingdom ..... 102/DIG. 10

OTHER PUBLICATIONS

Rethorst et al., *High Performance Hollow Projectiles*, VRC Report No. 26, 8/17/73, p. IV.

*Primary Examiner*—Verlin R. Pendegrass
*Attorney, Agent, or Firm*—Nathan Edelberg; A. Victor Erkkila; Max Yarmovsky

[57] ABSTRACT

A spherical convex pusher plate member is positioned intermediate the rear end of a subcaliber tubular projectile and the forward section of a cup shaped sabot carrier to improve the ballistic performance of the projectile by reduction of a parasitic weight and faster separation of the carrier after launch. Propellant gas pressures acting on the convex spherical section of the pusher plate causes deflection thereof sufficient to force the sabot to loosen from the projectile to provide an improvement in projectile velocity.

4 Claims, 2 Drawing Figures

SABOT ASSEMBLY FOR A SUBCALIBER SPIN STABILIZED PROJECTILE

GOVERNMENTAL INTEREST

The invention described herein may be manufactured, used and licensed by or for the Government for governmental purposes without the payment to us of any royalty thereon.

BACKGROUND OF THE INVENTION

Various techniques have been used in the past to obtain improved velocity performance of projectile in order to enhance the projectiles penetrating abilities. One of the means used in the prior art for accomplishing this is to combine an armor piercing projectile with a sabot-carrier. The sabot type projectiles generally are subcaliber with respect to the launch weapon and require the use of an adapter such as a sabot to support the projectile during launch. The sabot in order to satisfy its main function as a projectile carrier must serve as a gas seal within the launch tube, remain intact during travel down the bore of the gun, impart rotation to spin-stabilized projectile, and after discharge from the gun separate from the projectile without disturbing the flight of the projectile and without creating a debris hazard to launch personnel. The high acceleration generally encountered in sabot projectiles frequently gives rise to coupling stresses at the contact interface between the sabot and the projectile. In the past a flat steel pusher plate was interposed between the rear of the projectile and the front face of a plastic cup shaped sabot to absorb some of this stress and to prevent a sabot made from plastic type material from being strained to the point of failure during travel in the gun bore. Since the ratio of the weight of the propellant to the weight of the projectile is a function of the desired velocity, it is imperative to reduce the parasitic weight of the pusher plate as much as practically possible. The problem with prior art pusher plates has been that they are not only too heavy but that they frequently fail to help the sabot separate cleanly from the projectile in the short time required after the assembly leaves the gun muzzle and consequently affects the aerodynamic stability of the projectile and reduces the ultimate velocity of the projectile.

SUMMARY OF THE INVENTION

The present invention relates to a molded plastic sabot assembly having a spherical convex shaped steel pusher plate operatively disposed therein. The present device utilizes a pusher plate having a dual function. The present device is substantially lighter in weight than the standard flat steel pusher plate and is designed to provide for faster separation of the sabot from the projectile.

An object of the present invention is to provide a spherical convex pusher plate which reduces the parasitic weight of a sabot launched projectile.

Another object of the present invention is to provide a spherical convex pusher plate for a cup shaped sabot launched projectile which insures cleaner and faster separation of the rear of the sabot from the projectile.

A further object of the present invention is to provide a spherical convex shaped pusher plate which insures increased projectile velocity for the same amount of propellant.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 2:
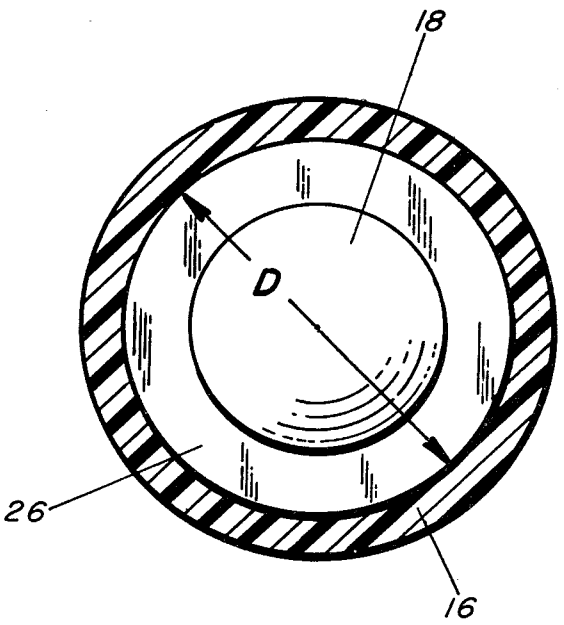
FIG. 2 is a cross-sectional view taken along line 2—2 of FIG. 1.
Figure 1:
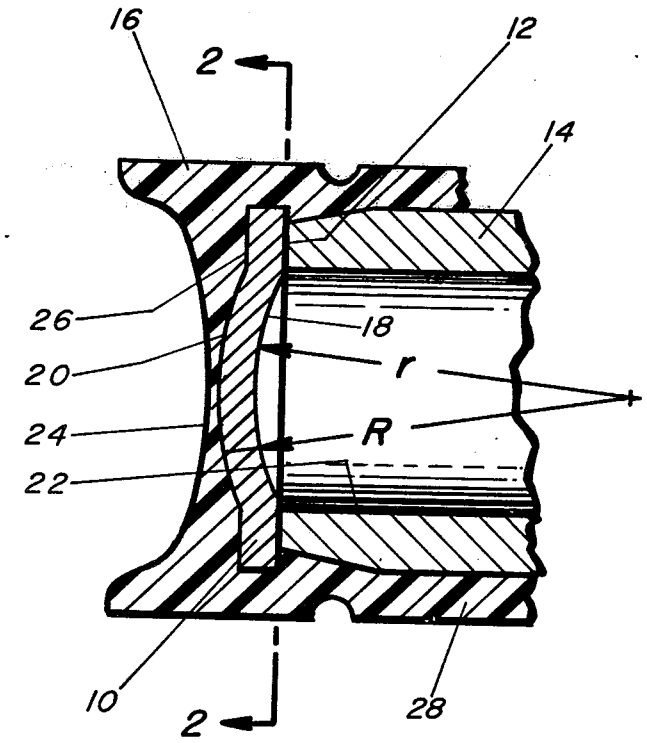
FIG. 1 is a diametral longitudinal partial cross-section view of the sabot-pusher plate-projectile assembly.

Referring now to FIGS. 1 and 2 a spherical convex, steel pusher plate 10 is fixedly and axially disposed intermediate the rear end 12 of 60mm, spin stabilized tubular projectile 14 and the spherical concave inner closed end of a molded plastic cup shaped 75mm sabot housing 16. The housing 16 is positioned circumambient of the projectile 14. The round shown in FIG. 1 is designed to be fired out of a 75mm gun with 48,000 p.s.i., chamber pressure at a 5430 ft/sec muzzle velocity. In the past in order to satisfy such velocity requirements it would often be necessary to use a 0.5596 inch thick steel flat pusher plate in order to prevent the coining effect on the plate under the 48,000 p.s.i., chamber pressure. The prior art flat plate having an outside diameter equal to the pusher plate 10, would weigh approximately 4900 grains. In the preferred embodiment shown in FIGS. 1 and 2, the spherical convex pusher plate 10 has a central curved section having a cross-section thickness whose inner spherical concave surface 18 and inside radius "r" of 2.3 inches and an outside convex spherical surface 20 having an outside radius "R" of 2.52 inches. The pusher plate 10 is designed to deflect 0.1 inches under 48,000 p.s.i., chamber pressure and therefore require only a cross-sectional thickness of 0.22 inches which is less than one half of the thickness of the aforementioned prior art flat plate design. The spherical convex dish shaped pusher plate 10 is spherically shaped only to the inside edge of the interior wall 22 of projectile 14. The spherical convex pusher plate 10 having a disk outside diameter "D" dimension of approximately 2.362 inches weighs 4190 grains and is 710 grains lighter than the prior art flat circular plates of the same diameter aforedescribed resulting in a net weight saving of 14.5%.

In operation, where 48,000 p.s.i., propellant gas pressure is exerted against a rear end sabot concave surface 24, the spherical concave section 18 of pusher plate 10 deflects in a direction toward the front end of projectile 14. The plate 10 simultaneously absorbs stress, and causes the outside diameter "D" of pusher plate annular shoulder section 26 to increase approximately 0.05 inches. The increase in the outside diameter of pusher plate 10 will force the rear end 28 of the sabot 16 to loosen from the projectile 14 and separate more readily therefrom as the assembly exits from the muzzle of the gun, thus increasing the projectile velocity for the same amount of propellant.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. An apparatus for launching a spin stabilized hypervelocity subcaliber tubular projectile from a gun which comprises:

sabot means for obturating said subcaliber projectile passing through the barrel of said gun and for imparting rotation to said projectile which includes;

a cup shaped molded plastic housing having a spherical concave inner closed end therein; and pusher plate means fixedly molded within said spherical concave inner closed end of said housing intermediate said sabot means and the rear end of said projectile for increasing the velocity of said projectile by reducing the parasitic weight of said pusher plate means, for aiding the removal of said means from said projectile after said projectile exits from the bore of said gun and for absorbing stress imposed on said sabot means and said projectile due to launch forces.

2. An apparatus for launching a spin stabilized subcaliber tubular projectile as recited in claim 1 wherein said pusher plate means comprises a spherical convex, plate having a central curved section, an inner spherical concave surface of said central curved section having a radius of curvature "r" and a convex spherical surface having a radius of curvature of "R", and a flat annular shoulder section integrally connected with said central curved section forming a plate having an outside diameter "D".

3. An apparatus as recited in claim 2 wherein said spherical convex plate is made of steel material.

4. An apparatus for launching a spin stabilized hypervelocity subcaliber tubular projectile from a gun which comprises:

sabot means for obturating said subcaliber projectile passing through the barrel of said gun and for imparting rotation to said projectile which includes;

a cup shaped molded plastic housing having a spherical concave inner closed end therein;

pusher plate means fixedly molded within said spherical concave inner closed end of said plastic housing and intermediate said sabot means and the rear end of said projectile for increasing the velocity of said projectile by reducing the parasitic weight of said pusher plate means, for aiding the removal of said means from said projectile after said projectile exits from the bore of said gun and for absorbing stress imposed on said sabot means and said projectile due to launch forces which includes:

a spherical convex plate having a central curved section, an inner spherical concave surface of said central curved section having a radius of curvature "d" and a convex spherical surface having a radius of curvature of "R", and a flat annular shoulder section integrally connected with said central curved section forming a plate having an outside diameter "D" wherein said spherical convex plate is made of steel having a cross-section thickness which allows said plate to deflect 0.1 inches when subjected to a propellant chamber pressure of 48,000 p.s.i., causing said outside diameter "D" of said plate to increase approximately 0.05 inches and aids in the removal of said sabot means for said projectile when said projectile exits from the bore of said gun.

* * * * *